US010384248B2

(12) United States Patent
Breuer

(10) Patent No.: US 10,384,248 B2
(45) Date of Patent: Aug. 20, 2019

(54) ALUMINUM HOT STRIP ROLLING TRAIN AND METHOD FOR HOT ROLLING AN ALUMINUM HOT STRIP

(71) Applicant: SMS Group GmbH, Duesseldorf (DE)

(72) Inventor: Michael Breuer, Hilchenbach (DE)

(73) Assignee: SMS GROUP GMBH, Duesseldorf (DE)

( * ) Notice: Subject to any disclaimer, the term of this patent is extended or adjusted under 35 U.S.C. 154(b) by 400 days.

(21) Appl. No.: 15/030,446

(22) PCT Filed: Sep. 16, 2014

(86) PCT No.: PCT/EP2014/069724
§ 371 (c)(1),
(2) Date: May 20, 2016

(87) PCT Pub. No.: WO2015/058902
PCT Pub. Date: Apr. 30, 2015

(65) Prior Publication Data

US 2016/0256906 A1 Sep. 8, 2016

(30) Foreign Application Priority Data

Oct. 25, 2013 (DE) ..... 10 2013 221 710

(51) Int. Cl.
*B21B 1/22* (2006.01)
*B21B 3/00* (2006.01)
(Continued)

(52) U.S. Cl.
CPC ..... *B21B 1/22* (2013.01); *B21B 3/00* (2013.01); *B21B 45/0215* (2013.01); *B21B 2001/225* (2013.01); *B21B 2003/001* (2013.01); *B21B 2015/0021* (2013.01); *B21B 2015/0057* (2013.01)

(58) Field of Classification Search
CPC ..... B21B 37/74; B21B 2003/001; B21B 2001/225; B21B 2015/0057; B21B 2015/0021; B21B 1/22; B21B 45/0203
See application file for complete search history.

(56) References Cited

U.S. PATENT DOCUMENTS 6,543,122 B1 4/2003 Perkins
8,327,918 B2 12/2012 Seidel
(Continued)

FOREIGN PATENT DOCUMENTS

DE 2020110250449 10/2011
EP 2233219 9/2010
(Continued)

*Primary Examiner* — Pradeep C Battula
(74) *Attorney, Agent, or Firm* — Abelman, Frayne & Schwab

(57) ABSTRACT

An aluminum hot strip rolling mill including a multi-stand tandem finishing rolling train (2), at least one winding reel (8) arranged downstream, in the rolling direction, of the multi-stand tandem finishing rolling train, a cooling section (4) provided in the outlet region of the aluminum hot strip rolling mill, and at least one trimmer (6) paired with the multi-stand tandem finishing rolling train and arranged downstream, in the rolling direction, in the rolling direction, of the multi-stand tandem rolling mill train.

5 Claims, 6 Drawing Sheets

Figure 1:
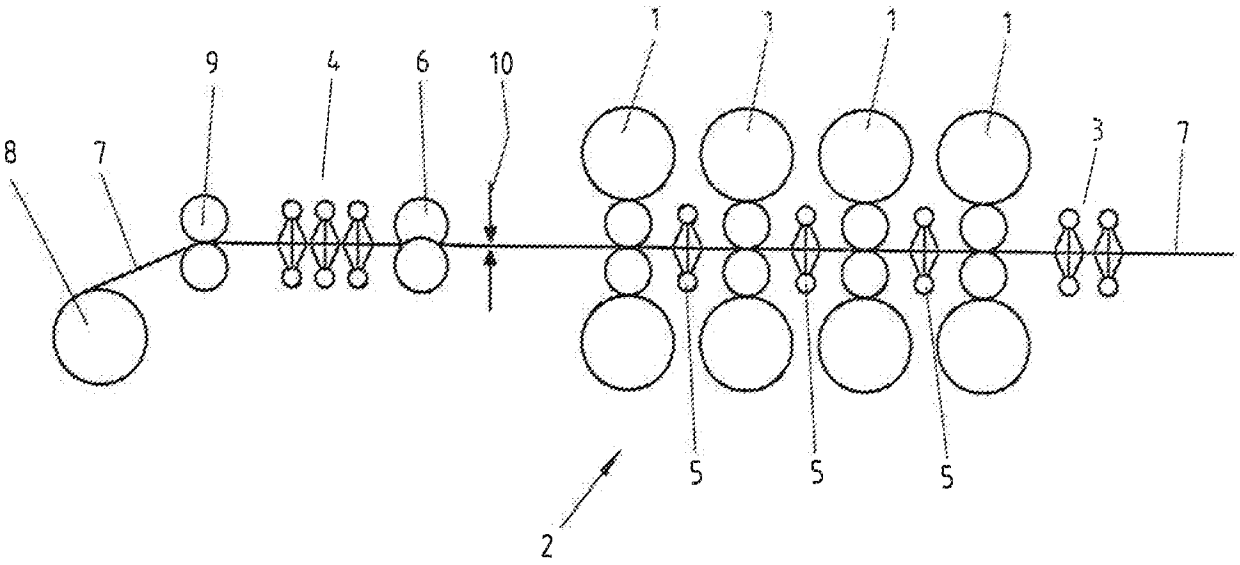

(51) Int. Cl.
*B21B 45/02* (2006.01)
*B21B 15/00* (2006.01)

(56) References Cited

U.S. PATENT DOCUMENTS

| | | | | |
|---|---|---|---|---|
| 8,356,503 | B2 | 1/2013 | Breuer | |
| 8,601,851 | B2 | 12/2013 | Seidel | |
| 9,180,505 | B2 | 11/2015 | Imanari | |
| 2002/0031682 | A1* | 3/2002 | Dif | B32B 15/016 428/654 |
| 2003/0150587 | A1* | 8/2003 | Li | B21B 37/74 164/452 |
| 2008/0251232 | A1* | 10/2008 | Benedetti | B21B 1/463 164/476 |
| 2010/0116456 | A1* | 5/2010 | Benedetti | B21B 1/463 164/454 |
| 2010/0275667 | A1 | 11/2010 | Seidel | |

FOREIGN PATENT DOCUMENTS

| | | |
|---|---|---|
| GB | 2291988 | 2/1996 |
| JP | 60170521 | 9/1985 |
| JP | 2012140664 | 7/2012 |
| WO | 2011036093 | 3/2011 |

* cited by examiner

ALUMINUM HOT STRIP ROLLING TRAIN AND METHOD FOR HOT ROLLING AN ALUMINUM HOT STRIP

RELATED APPLICATIONS

This application is a National Stage Application of International Application PCT/EP2014/069724 filed Sep. 16, 2014 and which claims priority of German application DE 10 2013 221 710.2 filed Oct. 25, 2013, both applications being incorporated herein by reference thereto.

The invention relates to an aluminum hot strip rolling train including a multi-stand finishing rolling train having downstream thereof, in a rolling direction, a winding reel and at least one cooling section associate therewith.

The invention further relates to a method of hot rolling an aluminum hot strip of AlMgSi-alloy from AA6xxx-group in an aluminum hot strip rolling train and a method of hot rolling an aluminum hot strip of AlMg-alloy from AA5xxx-group in an aluminum hot strip rolling train. Finally, the invention relates to the use of an aluminum hot strip produced according to one of the methods.

As contemporary tandem rolling mills for hot rolling of aluminum alloys, universal rolling mills are used in which all rollable grades of aluminum alloys of groups AA1xxx, AA2xxx, AA3xxx, AA5xxx, AA6xxx, AA7xxx, and AA8xxx (aluminum alloys according to DIN EN 573-3 and DIN EN 573-4) are rolled and produced with desired end dimensions.

These aluminum tandem hot rolling mills are formed very compact with a spacing between stands of 4 m and 6 m. At larger distances between the stands, there is a danger that the strip because of a sidewise displacement, does not enter any more the following stand centrally. At smaller distances, the devices necessary for rolling such as, e.g., as tension-measuring rolls and carry-over tables are not any more accessible, e.g., for monitoring purposes.

Further, these compact tandem rolling mills permit to handle all aluminum grades even such which require very high rolling speeds and/or greater thicknesses for achieving a reeling temperature of above 300° C. because of their low yield strength and, therefore, a smaller absorption of the deformation heat.

These compact tandem rolling mills have no cooling devices nowadays which could influence the strip temperature during rolling. The setting of the end rolling temperature is carried out by regulating the rolling speed. The reeling temperature corresponds to the end rolling temperature reduced by a free convection cooling of several ° K between the last stand and the winding reel. A purposeful influence of the temperature-time diagram and/or independent setting of the end rolling and reeling temperature is not possible.

Because of temperature-dependent recrystallization processes and diffusion processes during hot rolling of the aluminum, the material characteristics of the hot rolled aluminum alloys or aluminum strips which can be achieved with the stand-of-the art aluminum tandem finishing rolling trains, are limited. The cooling curves or the temperature-time diagrams which can be obtained with respective rolling speeds, are limited.

DE 44 45 072 A1 discloses an aluminum hot strip rolling train having, at the inlet side of a multi-stand tandem finishing rolling train, an associated cooling section with a task of insuring that an aluminum strip enters the tandem finishing rolling train with a constant temperature over its entire length. In this case, the temperature-time diagram which is obtained in the tandem finishing rolling train and thereby the cooling curve are firmly set and are no longer controlled or regulated independent on the result of the inlet side cooling.

The subject aluminum hot strip rolling train is also disclosed in DE 20 2011 050 449 U1. This publication discloses an aluminum hot strip rolling train with a two-part tandem finishing rolling train wherein a cooling section is provided between the two parts of the tandem finishing rolling train. This cooling section functions as the cooling section provided in the inlet region of the tandem finishing rolling train because after passing a portion of the tandem stands, the aluminum hot strip thickness is reduced, and the hot strip temperature is smaller in comparison with the inlet temperature when it reaches the cooling section. In addition, with this installation, it is possible to carry out a greater thickness reduction in the first tandem finishing stands than with rolling mills having a cooling section in the inlet region because the temperature increase which results from a greater deformation, can be again reduced by the cooling section in front of the inlet of the second portion of the tandem finishing rolling train.

The drawback of this configuration of this installation consists in that because of the required large spacing between the stands, a greater installation space is needed and, on the other hand, the production process is unstable due to the danger of a sidewise run of the strip during its insertion and exit. Further, for grades which do not require any cooling such as, e.g., light A1xxx or A3xxx grades, the possibilities of process management with regard to the temperature control are very limited. Specifically for the above-mentioned grades, a reeling temperature above 300° C. is very favorable for obtaining recrystalization processes in the coil which permits to reduce force and work requirements during the following cold rolling processes. The large distance between both tandems finishing rolling train portions leads here to an undesirable, uncontrollable temperature reduction.

The state-of-the art tandem finishing rolling trains do not permit setting of a specific temperature control in the tandem finishing rolling trains which would provide for an adjustable cooling process of the aluminum hot strip as it passes through a tandem finishing rolling train, and thereby to influence temperature-dependent recrystalization processes and/or diffusion processes which takes place in a rolled aluminum hot strip.

Accordingly, the object of the invention is to provide a solution which would permit to obtain improved cooling curves and temperature-time diagram during rolling of an aluminum hot strip during its rolling in a tandem finishing rolling train.

A further solution should be provided which would permit to eliminate or reduce dormant phases of the material before further processing which are necessary at present, and thereby, reduce the production time which results in an increased output, while providing simultaneously a compact construction by reducing the distance between the stands, and providing a separate adjustment of rolling and winding temperature.

With an aluminum hot strip rolling train of the type described in detail above, the objects of the invention are achieved by providing at least one cooling section in the outlet region of the aluminum hot strip rolling train, and at least one trimming shears located downstream, in a rolling direction, of the tandem finishing rolling train.

In a further improvement, the invention contemplates providing cooling means between at least two rolling stands of the multi-stage finishing rolling line.

The invention makes possible to carry out in a variety of ways the process of cooling an aluminum alloy rolled in a tandem finishing rolling train and, finally, wound on a winding reel or an aluminum hot strip consisting of this alloy. This process is supported by the at least one trimming shears.

Trimming shears can be provided in the outlet region of the tandem rolling train. They are advantageous for removing irregular hot strip edges which may contain tears and which are caused by process condition, and, thus, for obtaining regular, uniform edges. These shears are adjustable for removal of about 2 to 150 mm of the strip edge. With so defined strip edges, any provisions for monitoring temperature gradients produced on the strip edges during rolling, can be dispensed with. A possible unflatness in the region of the strip edges can be prevented, as a rule, by cooling in such a way, that flatness would become more pronounced. Further, a simplified width-dependent adjustment of the cooling device due to reliable knowledge of the trimmed strip width, becomes possible.

Intermediate cooling means, within the meaning of the invention, is formed by a cooling device provided between two rolling stands of the tandem rolling train. It can apply, e.g., a cooling medium in amount from about 500 l/min to 15,000 l/min to a strip.

A cooling section, within the meaning of the invention, is formed by a cooling device provided between the last rolling stand of the tandem rolling train and the winding mill. It can apply a cooling medium to the strip in amount from 2,000 l/min to about 50000 l/min. These large amount is necessary for achieving a suitable cooling of the strip.

The intermediate cooling permits to purposefully adjust the temperature during deformation and the end rolling temperature. With the cooling section provided at the outlet of the aluminum hot strip rolling train, in particular at the outlet of the multi-stand finishing rolling train, it is possible to purposefully adjust the winding temperature. Here, under an end rolling temperature, a temperature of the aluminum hot strip that exits the tandem finishing rolling train after the last rolling pass, is understood, and under a reeling temperature, a temperature of the rolled aluminum hot strip wound on the winding reel, is understood.

Thereby, it is possible to purposefully influence the cooling and the produced, as a result, the metallographic structure both in the temperature range of recrystallization from 300° C. to 370° C. and in the temperature range of diffusion processes from 230° C. to 280° C.

This permits to carry out, e.g., with AA6xxx-grade, heat deformation in the region of recrystallization in the temperature range between 300° C. and 370° C. to obtain as uniform as possible metallographic structure with a good grain fineness, wherein simultaneously, the reeling temperature, dependent on the material, can be adjusted in the range from below 200° C. to below 250° C. in order to prevent the flow of diffusion processes or to noticeably slow them and, thereby, to prevent formation of large precipitation as a result of the diffusion processes during winding or cooling of the aluminum hot strip on the winding reel. A precise, alloy-dependent adjustment of the reeling temperature is very important as, thereby, a temperature is set at which the diffusion processes do not take place any more or are noticeably slowed. With the invention, it is also possible to roll a number of aluminum alloys, without loss of the production output, with an end rolling temperature 300° C. to 370° C. and to achieve, alloy-dependent, lower reeling temperatures in a range from below 200° C. to below 250° C. by using the cooling section in the outlet region of the aluminum hot strip rolling train.

Lowering the end rolling temperature to the range from 300° C. to 370° C. is achieved with the intermediate cooling devices which enable to purposefully cool the aluminum hot strip and/or to remove, from a coil, the heat generated by hot rolling in the stands of the finishing train. The intermediate devices, which are provided between the stands, permit to set a desirable temperature for each pass after each tandem stand of the tandem finishing rolling train in the rolling direction. Thus, the aluminum hot strip can be subjected to a greater number of passes under a lower temperature than in the state-of-the art. Thereby, the production output of an aluminum hot strip rolling train, fitted, in particular retrofitted with a such tandem finishing rolling train, can be increased.

The presence of water-containing material on the aluminum strip during its winding onto a winding reel lead to a corrosive attack and surface discoloration. Because the aluminum strip is not subjected to pickling, the surface defects remain and result eventually in loss of quality or rejects if this process in not opposed by strip drying. The invention is characterized in that, in an advantageous embodiment, strip drying means is provided downstream, in the rolling direction, of the cooling section and in front of the winding reel and which includes a drying device and/or cooling medium-removing devices. Because of low temperatures which results from operation of the cooling section, the aluminum hot strip cannot be completely cooled by its own heat, the provision of the strip drying means downstream of the cooling section and in front of the winding reel is advantageous.

According to an advantageous modification, the invention is characterized in that the cooling section and the intermediate cooling devices are formed for carrying out laminar cooling or spray cooling.

Thereby, advantageously, cooling effect in the temperature range of about 300° C. and below is achieved, in which range at higher temperatures, transition boiling and at lower temperatures, bulk boiling takes place. This range is characterized by a particular strong temperature-dependent change of the heat transfer coefficient the value of which starting from the value set at about 300° C. and up to a temperature of about 250° C., rises sharply and then again drops sharply up to the range of about 200° C. In a further embodiment of the invention, the aluminum hot strip rolling train includes a control and/or regulating device that controls the rolling stands, the cooling section, and the intermediate cooling device independently from each other, and rolling stand speed, intermediate cooling, and the winding temperature are adapted to a respective aluminum hot strip material and, in particular, are set and regulated independently from each other.

A particularly advantageous cooling effect is achieved by cooling the aluminum hot strip with rolling emulsion or demineralized water, therefore, the invention contemplates that the cooling section and the intermediate cooling means are supplied with a rolling emulsion or demineralized water as a cooling medium.

Advantageously, the inventive aluminum hot strip rolling train is further characterized in that an upstream strip cooler is arranged in the inlet region of the tandem finishing rolling train. Thereby, it is possible to purposefully apply cooling action to an aluminum hot strip entering the tandem finishing rolling train.

Because, as discussed above, the heat transfer coefficient experiences a strong temperature-dependent change in the temperature range of the transition boiling and bulk boiling, it is expedient to incorporate it in a technical process model that underlies the control and/or regulating device. Therefore, the invention is further characterized in that in the control and/or regulating device, a process model is stored and mapped and that changes of heat transfer coefficients during cooling of the aluminum hot strip are monitored and used in control and/or regulating processes of the aluminum hot strip rolling train and, in particular, of the tandem finishing rolling train with the upstream cooler, and/or the intermediate cooling device, and/or cooling section, and/or strip drying means.

In order to be able to take into account the measured temperature of the respective aluminum hot strip and to pass-dependent influence it, it is advantageous when a process model is stored and mapped in the control and/or regulating device, that feedback of respective temperature levels of the aluminum hot strip on friction between respective rolls and respective aluminum hot strip material is monitored and used in control and/or regulating processes of the aluminum hot strip rolling train, in particular of the tandem finishing rolling train with the upstream cooler, and/or the intermediate cooling device and/or cooling section, and/or strip drying means, which is also contemplated by the invention.

Because of different, independently from each other controlled and activated devices which include at least one cooling section, intermediate cooling means, and, as the case may be, upstream cooling, the inventive aluminum hot strip rolling train makes it possible to purposefully adjust, independent from each other and independent from respective adjusted and likewise independent from cooling, controllable speed(s), cooling curves in form of specific, desirable temperature-time diagram dependent on alloy during production of the aluminum hot strip.

For so-called HT-grads (heat-treatable curable alloy), an end product with particularly finely distributed precipitations and favorable mechanical characteristics can be produced.

During production of NHT-grades (non-curable alloys), the temperature range of the last deformation, i.e., at the last pass in the tandem finishing rolling train, can be reduced, without losses of the production output to such an extent that cold deformation in the material, without recrystallization, continues at the following winding and cooling of the formed coil on the winding reel. Thereby, the strength of such an aluminum hot strip noticeably increases in comparison with one produced according to the state-of-the art.

The inventive aluminum hot strip rolling train permits to produce, in this manner, for AA5xxx-alloys, H2- or even H3-grades, without the otherwise necessary, additional step of cold rolling The object of the invention is also achieved by a method of hot rolling of an aluminum hot strip from AlMgSi-alloy of the AA6xxx-group in an aluminum hot strip rolling train and which includes steps of:

heating an aluminum alloy ingot of AlMgSi-alloy from AA6xxx-group to a temperature from 490° C. to 570° C.;

rough rolling the aluminum alloy ingot to an aluminum hot strip having a thickness from 20 mm to 50 mm in a roughing train of the aluminum hot strip rolling train in a temperature range above 400° C.;

rolling the aluminum hot strip in a multi-stand finishing rolling train of the aluminum hot strip rolling train with activated cooling devices between the tandem stands of the finishing rolling train so that during last two rolling passes in a temperature range between 300° C. and 370° C., a deformation rate between 30% and 50% and a desired hot strip thickness between 2 mm and 6 mm is achieved;

trimming of the hot strip; and cooling of the aluminum hot strip in an outlet region of the aluminum hot strip rolling train with a cooling section to a reeling temperature of below 250° C., preferably to a reeling temperature from 150° C. to 230° C., wherein the process of finish rolling in the multi-stand tandem finishing rolling train is carried out within a time period of less than 60 sec.

For other wrought alloys, such as, e.g., of groups AA2xxx or AA7xxx, specific values are adjusted.

Thereby, e.g., an aluminum rolling product or an aluminum hot strip can be produced which in particular has necessary characteristics for an automotive industry and, after treatment, in a T-4 condition, has a high deformability, without a reduced, or reduced to a small extent, roping, and in T6-condition which, as a rule, is achieved by heating after varnishing, has a further increased strength. Thereby, the references T4 and T6 point to a clue for heat treatment according to DIN EN 515.

By limiting the duration of the process of finish-rolling to a time period of less than 60 sec, formation of precipitates is prevented.

The object is also, e.g., achieved by a method of hot rolling an aluminum hot strip of AlMg-alloy from AA5xxx-group, e.g., AA5052, in an aluminum hot strip rolling train, comprising the steps of:

heating an aluminum alloy ingot of AlMg-alloy from AA5xxx-group to a temperature from 450° C. to 570° C.;

rough rolling the aluminum alloy ingot to an aluminum hot strip having a thickness from 20 mm to 50 mm in a roughing train of the aluminum hot strip rolling train in a temperature range above 400° C.;

rolling the aluminum hot strip in a multi-stand finishing rolling train of the aluminum hot strip rolling train with activated cooling devices between the tandem stands of the finishing rolling train so that during last two rolling passes in a temperature range between 250° C. and 300° C., a deformation rate between 30% and 50% and a desired hot strip thickness between 2 mm and 6 mm is achieved;

trimming of the hot strip; and winding of the aluminum hot strip with or without use of the cooling section, wherein the process of finish-rolling of a strip element is carried out within a time period of less than 60 sec.

Thereby, an aluminum hot strip can be produced that already achieves, after hot rolling, a strength value that corresponds to H2 or H3 specification, without carrying out a cold rolling process.

The invention permits an advantageous use of the produced aluminum hot strips in components of a chassis, or a structural part, or a plate used in automobiles, planes, or rail cars, in particular as components of chassis part, outer or inner plate in car construction, in particular as chassis element.

The invention will be described in detail below with reference to the drawings.

Figure 2:
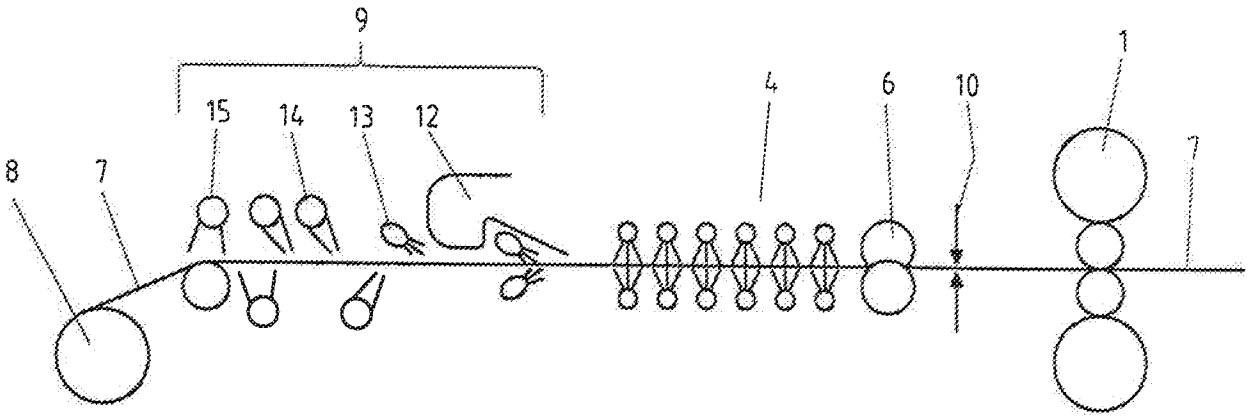
Figure 3:
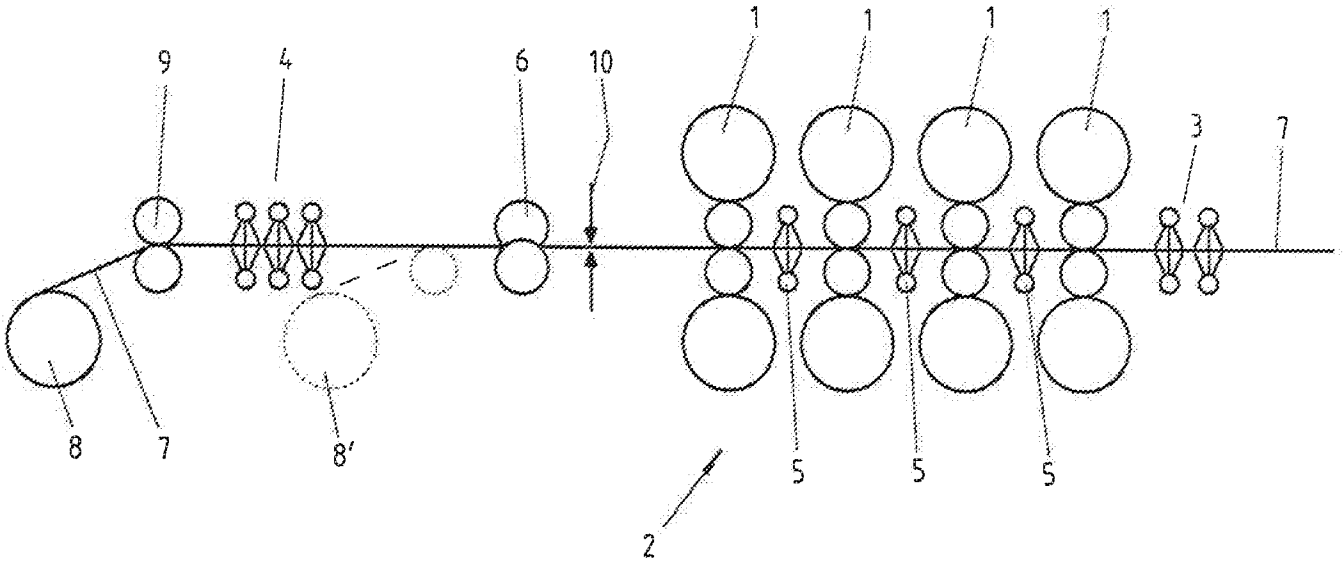
Figure 4:
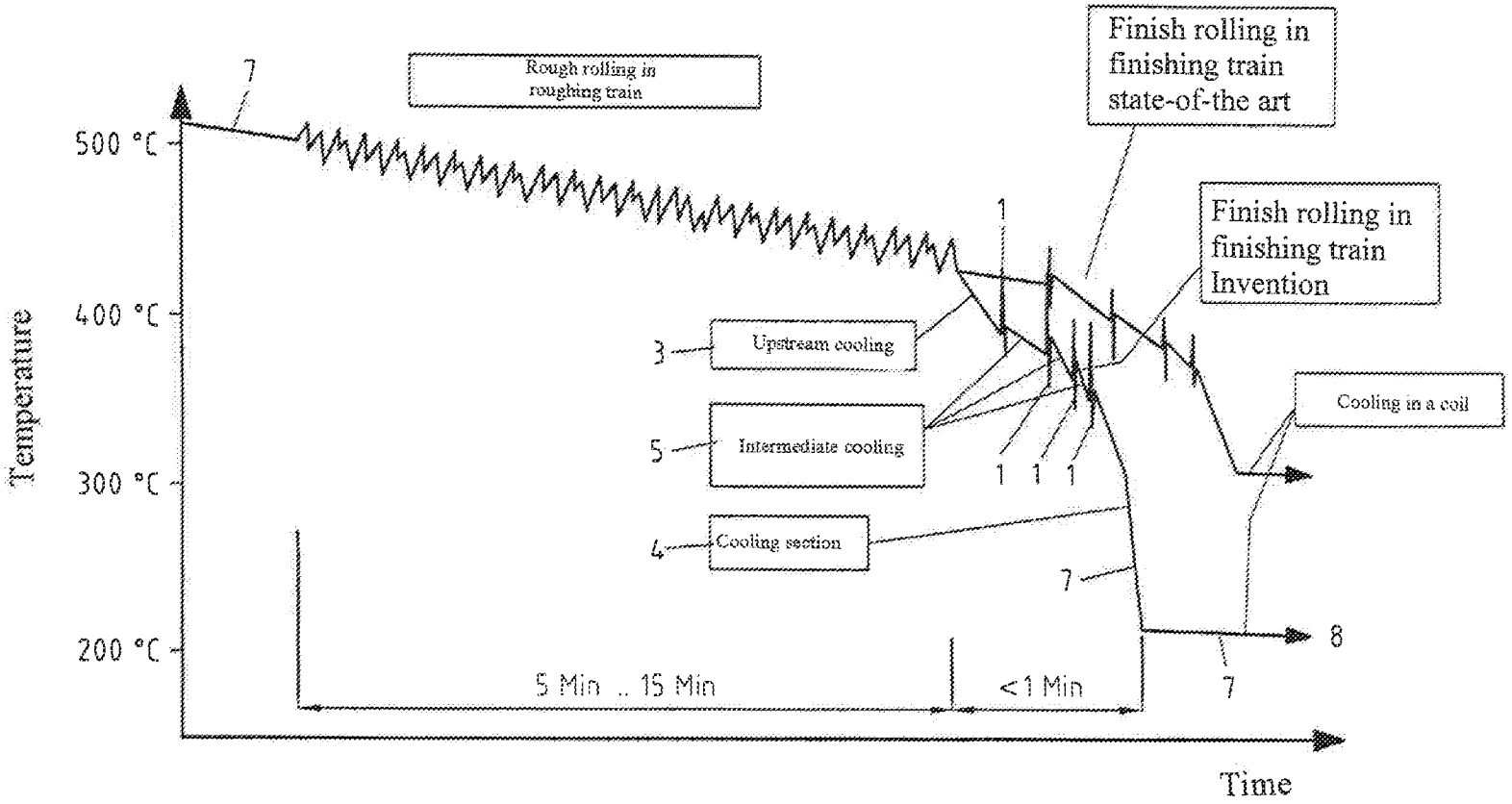
Figure 5:
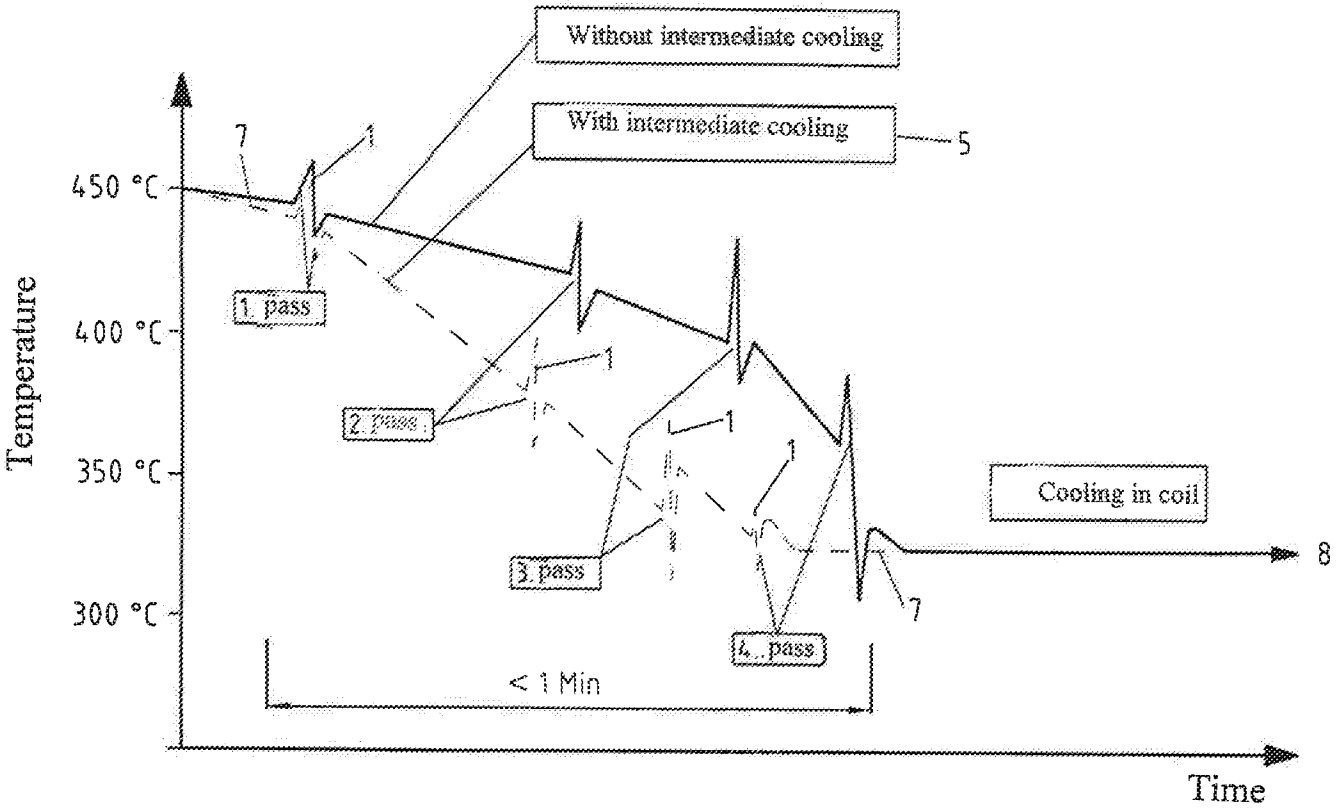
Figure 6:
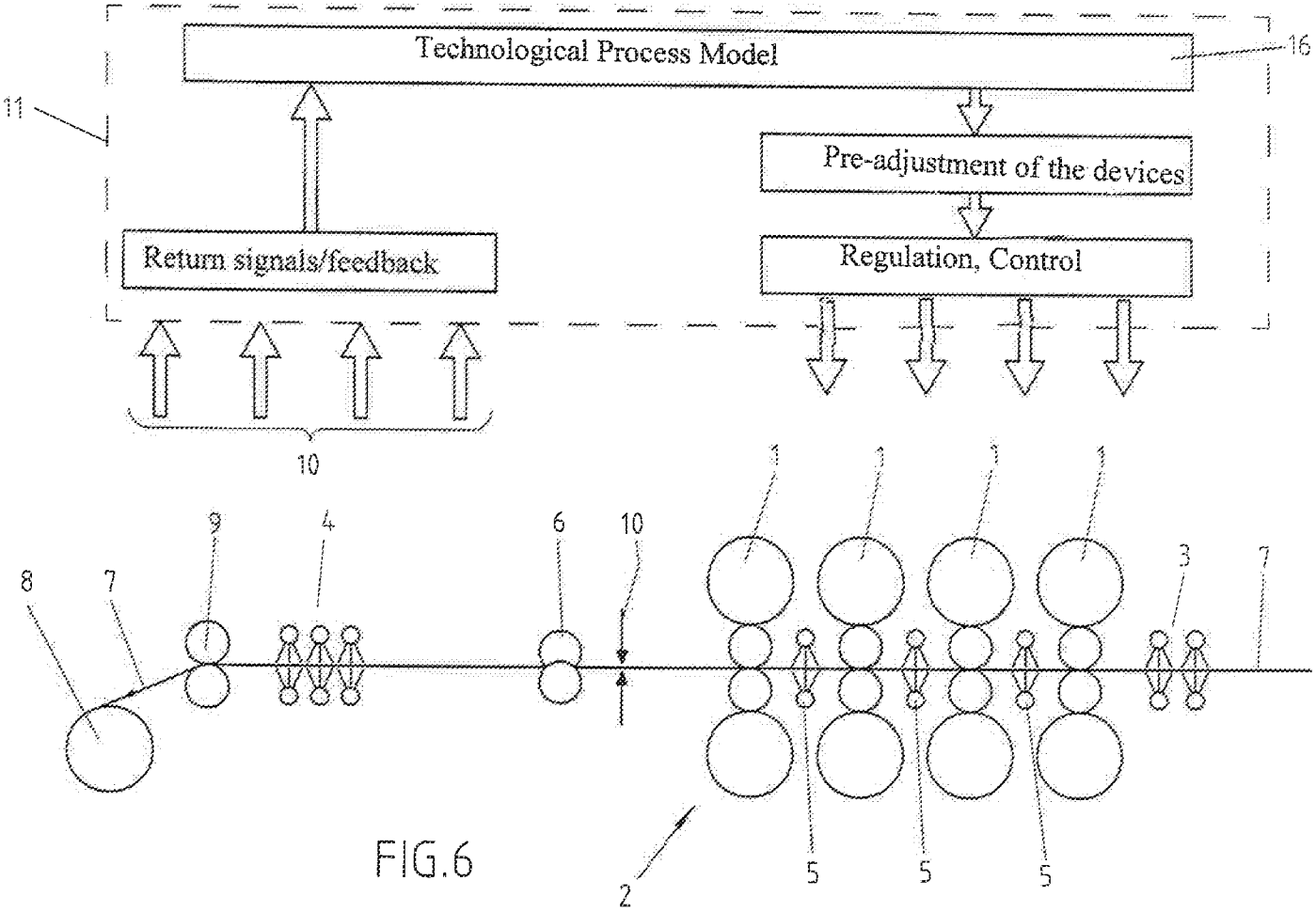

The drawings show:

FIG. 1 a section of a finishing rolling train of an inventive aluminum hot strip rolling train;

FIG. 2 a schematic view of particularities of strip drying means of the finishing rolling train according to FIG. 1;

FIG. 3 a section of a finishing rolling train of an aluminum hot strip rolling train retrofitted according to the present invention;

FIG. 4 a schematic view of a temperature-time diagram (cooling curve) obtained with the inventive aluminum hot strip rolling train in comparison with that of the state-of-the art;

FIG. 5 a schematic view of a temperature-time diagram (cooling curve) obtained in a four-stand tandem finishing rolling train of the inventive aluminum hot strip rolling train, without an activated cooling section in the outlet region, in comparison with the state-of-the art; and FIG. 6 a schematic view of a process control.

FIG. 1 shows a section of a tandem finishing rolling train of an aluminum hot strip rolling train according to the invention and including a multi-stand tandem rolling train 2 having four tandem stands 1, an upstream cooler 3 in the inlet region of the tandem finishing rolling train 2, and an associated cooling section 4 in the outlet region of the aluminum hot strip rolling train. Intermediate cooling means 5 is provided between separate tandem rolling stands 1. In the rolling direction, downstream of the tandem finishing rolling train 2 and in front of the cooling section 4, there is provided trimming shears 6, and in the rolling direction, downstream of the cooling section 4 and in front of the rolled aluminum hot strip-receiving winding reel 8, there is provided drying means 9. Between the tandem finishing rolling train 2 and the trimming shears 6, there are provided measuring apparatuses or measuring devices 10 with which strip temperature(s), strip speed(s), strip outer surface(s) and the like can be detected. These measuring apparatuses and devices 10 are operatively connected with shown in FIG. 6, control and regulating device 11 that can control and regulate, independently from each other, the tandem rolling stands 1, in particular the rolling speed, the cooling section 4, and the intermediate cooling means 5 and, if necessary or desired, the upstream strip cooler 3 and the drying means 9. The independent control and regulation of separate cooling devices consists, e.g., in that the activation and deactivation as well as the cooling medium mass flow rate applied to the aluminum hot strip 7 by the upstream strip cooler 3 but particularly by the intermediate cooling means 5 and the cooling section 4 can be carried out independent from one another and independent from the speed control. Therefore, it is possible, independently from each other, individually adapt and, independently from each other, adjust the rolling speed, intermediate cooling, end rolling temperature, and the reeling temperature for a respective to-be-rolled aluminum hot strip material of aluminum alloy. The strip drying means 9 which is arranged in front of the winding reel 8, makes it possible to remove the cooling medium which remains on the surface of the aluminum hot strip 7 after it passes the cooling section 4 and, thus, prevent surface defects. The cooling section 4 and the intermediate cooling means 5 are formed as laminar cooling means or spray cooling means. Advantageously, the cooling medium is (usually) water emulsion or demineralized water.

FIG. 2 shows that the drying means 9 includes drying devices and cooling medium removing devices in form of catchers with counter-spraying means 12, counter-spraying means 13, so-called air knives 14, and suction means 15.

FIG. 3 shows how the available aluminum strip rolling train can be readily retrofitted with cooling features according to the present invention. To this end, it is only necessary to extend the outlet region, if needed, and to move the available winding reel 8' to the position of the winding reel 8 to provide place for the cooling section 4 and the strip drying means 9, or to provide the winding reel 8 in addition to the winding reel 8'. Between the tandem stands 1 of the tandem finishing rolling train 2, the intermediate cooling means 5 is retrofitted and, if desired, the upstream cooler 3 is provided on the inlet side.

FIG. 4 shows cooling curves or temperature-time diagrams which provide for a noticeably more rapid cooling, and also for a temperature-dependent targeted cooling of the aluminum hot strip 7 according to the invention in the region of the multi-stand tandem finishing rolling train 2 of the inventive aluminum hot strip rolling train. While the cooling in tandem finishing rolling train 2 retrofitted according to the invention can be carried out within one minute or within 60 seconds and to noticeably lower temperatures, this cannot be achieved in installations according to the state-of-the art. FIG. 4 shows that the aluminum hot strip 7 after a rough rolling in a roughing rolling train of the aluminum hot strip rolling train, with the activated upstream cooler 3, the activated intermediate cooling means 5, and the cooling section 4, is rolled noticeably more rapidly to the end rolling temperature in the range between 300° C. and 360° C. and then is cooled to the winding temperature in the range from less than 200° C. to less than 250° C. before the aluminum hot strip 7 is wound on the winding reel 8, and is cooled further thereon.

FIG. 5 shows the effect of the intermediate cooling means in the four-stand tandem finishing rolling train 2, wherein the activation and the operation of the cooling section 4 in the outlet region on the temperature-time diagram before winding of the aluminum hot strip 7 onto the winding reel 8 and the cooling of the coil is dispensed with. The course of the cooling curve or of the temperature time curve, without the intermediate cooling, is shown with a solid line, and the cooling curve or the temperature time curve, with the activated intermediate cooling means, is shown with a dash line. FIGS. 4 and 5 show how the cooling process of the rolling and rolled aluminum hot strip can be selectively controlled so that dependent on the desired results with regard to grain fineness and dependent on the alloy, separate cooling devices 3, 4 and 5 are used, upon being activated, or remain unused, without being activated.

FIG. 6 shows schematically the control or regulating device 11 to which measured value detected by the measurement apparatuses or the measurement devices 10 and representing the results of rolling and the condition of the rolling process are fed back. These measured values are stored in a technological process model 16 incorporated in the control or regulating device 11. Those are so affected by the technological process model 16 which is incorporated and mapped in the control and/or regulating device 11, that the control and/or regulating processes change, taking into account changes of heat transfer coefficients during cooling of the aluminum hot strip 7. The technological process model 16 also takes into account the feedback of respective temperature levels of the aluminum hot strip 7 during separate passes in the tandem stands 1 of the tandem finishing rolling train 2 or the friction between the rolling emulsion or between separate rolls and a respective aluminum hot strip material when determining the control and/or regulating processes. As shown in FIG. 6, the technological process model 16 controls the setup of separate devices of the aluminum hot strip rolling train and, in particular, in the shown here, region of the tandem finishing rolling train 2 with the upstream cooler 3, intermediate cooling means 5, and the associated cooling section 4, and the drying means 9, generating regulating and/or control signals transmitted by the control and regulating device 11 to respective devices such as tandem stands 1, the upstream cooler 3, the cooling section 4, the intermediate cooling means 5, and the drying means 9. A component of the control and/or regulating device 11 is a computer, not shown in detail, in which the technological process model 16 is stored and which controls the course of the desired temperature-time diagram and the regulating device. The cooling devices 3, 4, and 5 can be so formed that they are controlled width-dependent with regard to the rolled aluminum hot strip.

In particular, it is possible to set up, with the inventive aluminum hot strip rolling train, individual, specific and, if necessary, alloy-dependent time curves with regard to the temperature and/or deformation rates set up in the tandem stands, in order to obtain the desired results with regard to the structure of a respective aluminum alloy of a rolled aluminum hot strip and, thereby, certain material characteristics and/or strength. With the inventive aluminum hot strip rolling train, it is also possible to carry out, independently from each other, control of deformation, of the (cooling) time, and of the temperature without production losses. Rather, an increase of the production in comparison with the similar finishing rolling trains of the state-of-the art is possible. For each aluminum alloy, such conditions can be set up that the precipitates are finely distributed. Thereby, noticeably better uniform elongation values are achieved. Formation of large precipitates can be prevented by a rapid cooling, after the hot rolling of the aluminum hot strip, to a temperature in a range from more than 200° C. to less than 250° C. in which the diffusion processes are not slown down or are slown down to a lesser degree. The intermediate cooling means 5 is used with a particular advantage when the recrystallization is carried out only partially or not at all at relatively low temperatures, so that the remaining deformation energy can be used as activation energy for recrystalization in a coil wound on the winding reel 8.

The invention claimed is:

1. A method of hot rolling an aluminum hot strip (7) of AlMg-alloy from AA5xxx-group in an aluminum hot strip rolling train, comprising the steps of:

heating an aluminum alloy ingot of AlMg-alloy from AA5xxx-group in a temperature 450° C. to 570° C.;

rough rolling the aluminum alloy ingot to an aluminum hot strip having a thickness from 20 mm to 50 mm in a roughing train of the aluminum hot strip rolling train in a temperature range above 400° C.;

rolling the aluminum hot strip (7) in a multi-stand tandem finishing rolling train (2) of the aluminum hot strip rolling train with activated cooling devices (5) between the tandem stands (1) of the multi-stand tandem finishing rolling train (2) so that during rolling in last two tandem stand in a temperature range between 250° C. and 300° C., a deformation rate between 30% and 50% and a desired hot strip thickness between 2 mm and 8 mm is achieved;

trimming of the hot strip; and winding of the aluminum hot strip, wherein the process of finish rolling of the strip element is carried out within a time period of less than 60 sec.

2. A method of hot rolling an aluminum hot strip (7) of AlMg-alloy from AA5xxx-group in an aluminum hot strip rolling train, comprising the steps of:

heating an aluminum alloy ingot of AlMg-alloy from AA5xxx-group in a temperature 450° C. to 570° C.;

rough rolling the aluminum alloy ingot to an aluminum hot strip having a thickness from 20 mm to 50 mm in a roughing train of the aluminum hot strip rolling train in a temperature range above 400° C.;

rolling the aluminum hot strip (7) in a multi-stand tandem finishing rolling train (2) of the aluminum hot strip rolling train with activated cooling devices (5) between the tandem stands (1) of the multi-stand tandem finishing rolling train (2) so that during rolling in last two tandem stands in a temperature range between 250° C. and 300° C., a deformation rate between 30% and 50% and a desired hot strip thickness between 2 mm and 8 mm is achieved;

trimming of the hot strip; and cooling of the aluminum hot strip in an outlet region of the aluminum hot strip rolling train with a cooling section (4) to a reeling temperature of below 250° C., and winding up the aluminum hot strip, wherein the process of finish rolling in the multi-stand tandem finishing rolling train (2) is carried out within a time period of less than 60 sec.

3. A method of hot rolling an aluminum hot strip (7) of AlMgSi-alloy from AA6xxx-group in an aluminum hot strip rolling train, comprising the steps of:

heating an aluminum alloy ingot of AlMgSi-alloy from AA6xxx-group to a temperature from 490° C. to 570° C.;

rough rolling the aluminum alloy ingot to an aluminum hot strip having a thickness from 20 mm to 50 mm in a roughing train of the aluminum hot strip rolling train in a temperature range above 400° C.;

rolling the aluminum hot strip (7) in a multi-stand tandem finishing rolling train (2) of the aluminum hot strip rolling train with activated cooling devices (5) between tandem stands (1) of the multi-stand tandem finishing rolling train (2) so that during rolling in last two tandem stands in a temperature range between 300° C. and 370° C., a deformation rate between 30% and 50% and a desired hot strip thickness between 2 mm and 6 mm is achieved;

trimming of the hot strip; and cooling of the aluminum hot strip in an outlet region of the multi-stand tandem finishing rolling train with a cooling section (4) to a reeling temperature of below 250° C., wherein the process of finish rolling in the multi-stand tandem finishing rolling train (2) is carried out within a time period of less than 60 sec.

4. A method of hot rolling aluminum hot strip (7) of AlMgSi-alloy from AA6xxx-group according to claim 3, wherein the cooling step comprises cooling of the aluminum hot strip to a reeling temperature from 150° C. to 230° C.

5. A method of hot rolling aluminum hot strip (7) of AlMgSi-alloy from AA5xxx-group according to claim 3, wherein the cooling step comprises cooling of the aluminum hot strip to a reeling temperature from 150° C. to 230° C.

* * * * *